US007808470B2

(12) United States Patent
Ozawa et al.

(10) Patent No.: US 7,808,470 B2
(45) Date of Patent: Oct. 5, 2010

(54) ELECTRO-OPTICAL DEVICE HAVING A MEMORY CIRCUIT FOR EACH PIXEL AND THAT CAN DISPLAY WITH LOW POWER CONSUMPTION

(75) Inventors: Yutaka Ozawa, Minowa-cho (JP); Suguru Yamazaki, Suwa (JP)

(73) Assignee: Epson Imaging Device Corporation, Azumino-shi (JP)

( * ) Notice: Subject to any disclaimer, the term of this patent is extended or adjusted under 35 U.S.C. 154(b) by 923 days.

(21) Appl. No.: 11/515,194

(22) Filed: Sep. 5, 2006

(65) Prior Publication Data

US 2007/0052657 A1 Mar. 8, 2007

(30) Foreign Application Priority Data

Sep. 7, 2005 (JP) ..... 2005-259553
May 1, 2006 (JP) ..... 2006-127779

(51) Int. Cl.
*G09G 3/36* (2006.01)

(52) U.S. Cl. ..... 345/100; 345/87; 345/98; 345/103; 345/204; 349/48; 365/190; 365/230.03

(58) Field of Classification Search ..... 345/98, 345/90, 100, 87, 103, 204; 349/48; 365/190, 365/230.03
See application file for complete search history.

(56) References Cited

U.S. PATENT DOCUMENTS 5,945,972 A * 8/1999 Okumura et al. ..... 345/98
6,127,998 A * 10/2000 Ichikawa et al. ..... 345/100
6,873,320 B2 3/2005 Nakamura
6,965,365 B2 11/2005 Nakamura
7,057,596 B2 6/2006 Miyazawa
7,592,990 B2 9/2009 Miyazawa
2002/0024485 A1 * 2/2002 Koyama ..... 345/87
2002/0030648 A1 * 3/2002 Yamamoto et al. ..... 345/87
2002/0036627 A1 * 3/2002 Yokoyama ..... 345/204
2002/0047822 A1 * 4/2002 Senda et al. ..... 345/90
2005/0122457 A1 * 6/2005 Song ..... 349/129

FOREIGN PATENT DOCUMENTS

JP A 08-286170 11/1996
JP A-2001-159883 6/2001
JP A-2002-175040 6/2002
JP A 2002-311902 10/2002
JP A 2002-311903 10/2002
JP A-2003 -302946 10/2003
JP A 2005-189274 7/2005

* cited by examiner

*Primary Examiner*—Lun-Yi Lao
*Assistant Examiner*—Priyank Shah
(74) *Attorney, Agent, or Firm*—Oliff & Berridge PLC

(57) ABSTRACT

An electro-optical device includes an X address decoder that selects one of plural X selection lines, a Y address decoder that selects one of plural Y selection lines, and plural pixel blocks. Each pixel block is provided with respect to an intersection of a corresponding X selection line and a corresponding Y selection lines. Each pixel block includes a pixel circuit and the pixel circuits corresponding to a column share a bit line and a complementary bit line. Each pixel circuit includes a memory circuit, a selection circuit, and a pixel electrode. The memory circuit includes plural transistors that become conductive between the bit line, the complementary bit line, and terminals of the memory circuit at the time of concurrent selection of an X selection line and a Y selection line corresponding to the pixel block to which the plural transistors belong.

9 Claims, 6 Drawing Sheets

ELECTRO-OPTICAL DEVICE HAVING A MEMORY CIRCUIT FOR EACH PIXEL AND THAT CAN DISPLAY WITH LOW POWER CONSUMPTION

This application claims the benefit of Japanese Patent Application No. 2005-259553, filed Sep. 7, 2005 and Japanese Patent Application No. 2006-127779, filed May 1, 2006. The entire disclosures of the prior applications are hereby incorporated by reference in their entirety.

BACKGROUND

1. Technical Field

The present invention relates to a technique for reducing power consumption of an electro-optical device having memory circuits each of which is provided for a corresponding one pixel.

2. Related Art

Portable electronic apparatuses are demanded by users to be flat and lightweight. As an electro-optical element such as a liquid crystal element and an organic electroluminescent element is suitable for fulfilling such requirements, it is widely used for an electro-optical device that functions as a display device of an electronic apparatus. Since this type of electro-optical device rewrites (i.e., refreshes) the state of each pixel for every frame regardless of the content of display, it consumes a large amount of power due to operation of a driving circuit for driving each pixel and/or a controlling circuit for control thereof, thereby making it hard to reduce power consumption.

In an effort to address the above problem, a technique for turning a pixel ON or OFF in accordance with a bit stored in a built-in static-type memory circuit has been proposed, where the memory circuit stores one bit for each pixel (Refer to JP-A-8-286170). The proposed art eliminates the need for refreshing the memory circuit, which makes it unnecessary to operate the driving circuit and other related circuits when a still picture is displayed, finally attaining lower power consumption.

According to the above-identified related art described in JP-A-8-286170, partial rewriting is achieved by configuring a data line driver in an address decoder scheme. First of all, a scan driver puts each of a plurality of transistors for memory circuit selection into a conduction state. With this scan operation, all of the transistors for memory circuit selection in one line become conductive. Concurrently therewith, a data line driver applies a data voltage for display, which is of either H level or L level, to a data bit line corresponding to a target pixel to be written as selected by an address decoder; while the data line driver concurrently applies a data voltage of the inverted level to a corresponding complementary data bit line, thereby carrying out data rewriting. The data line driver is put in a high impedance state for other data bit lines and complementary bit lines corresponding to other pixels, which are not to be rewritten, so that data which has already been written in the memory is retained.

Generally speaking, as a data line holds a large parasitic capacitance, it tends to be charged at a previously-fed electric potential even when there is no data supplied from the data line; and when memory circuit selection transistors become conductive, it is difficult to maintain previously-written data, meaning that there is a strong possibility of the occurrence of data inversion (rewriting error).

In order to prevent such a writing error from occurring in the technique described in JP-A-8-286170, it is generally known to pre-charge both of the data bit line and the complimentary bit line at H level.

However, if the data bit line and the complimentary bit line are pre-charged, the output of the memory circuit and either of the data bit line and the complimentary bit line will be short-circuited, resulting in a higher power consumption because both of them are at H level although the pre-charging thereof prevents the inversion of data.

In addition to the above, further reduction in power consumption of an electro-optical device as a unit device has been much desired, as current electronic apparatuses have to meet various requirements, including extended continuous operating time, smaller battery size, enhanced functions, to name but a few.

SUMMARY

An advantage of some aspects of the invention is that it provides an electro-optical device and an electronic apparatus that can display with low power consumption in a configuration in which a memory circuit is provided for each pixel.

According to an aspect of the invention, there is provided an electro-optical device that includes an X address decoder that selects one of a plurality of X selection lines, a Y address decoder that selects one of a plurality of Y selection lines, and a plurality of pixel blocks, each of the pixel blocks being provided with respect to an intersection of a corresponding one of the plurality of the X selection lines and a corresponding one of the plurality of the Y selection lines. Such an electro-optical device is further configured as follows. Each of the plurality of the pixel blocks includes at least one pixel circuit. The pixel circuits corresponding to a column share a bit line and a complementary bit line. Each of the pixel circuits includes a memory circuit, a selection circuit, and a pixel electrode. The memory circuit includes a plurality of transistors that become conductive between the bit line, the complementary bit line, and terminals of the memory circuit at the time of concurrent selection of an X selection line and a Y selection line corresponding to the pixel block to which the plurality of the transistors belong, where the memory circuit stores a data bit which is fed to the corresponding bit line when the plurality of the transistors are conductive. The selection circuit selects a signal that turns an electro-optical element into an ON state or an OFF state according to the data bit stored in the memory circuit so as to feed the selected signal to the pixel electrode. With this configuration, only a pixel block at which some display content arises is selected so that only the data bit stored in the pixel block is subjected to rewriting.

This aspect of the invention may be configured so that the memory circuit includes first, second, third, and fourth transistors. If so configured, the invention includes the first transistor, the gate electrode of which is connected to the Y selection line and the source electrode of which is connected to the bit line; the second transistor, the gate electrode of which is connected to the X selection line, the source electrode of which is connected to the drain electrode of the first transistor, and the drain electrode of which is connected to one terminal of an inverter circuit; the third transistor, the gate electrode of which is connected to the Y selection line and the source electrode of which is connected to the complementary bit line; and the fourth transistor, the gate electrode of which is connected to the X selection line, the source electrode of which is connected to the drain electrode of the third transistor, and the drain electrode of which is connected to the other terminal of the inverter circuit. In this configuration, it is preferable that channel widths of the second transistor and the fourth transistor are narrower than channel widths of the first transistor and the third transistor.

In addition, the invention may be configured so that the pixel blocks corresponding to a column share a single X selection line, or alternatively, the invention may be configured so that the pixel blocks corresponding to a column are divided into a plurality of groups, where the pixel blocks in each group share an X selection line. When configured as the latter of the above, it is preferable to have the following additional features. A plurality of the pixel circuits are arranged to form a line in each of the pixel blocks. The electro-optical element has a pixel capacity, which includes an individual pixel electrode provided individually for each pixel circuit and a common electrode shared by all of the pixel circuits. The array pitch of the pixel electrode is wider than the array pitch of the memory circuit when viewed along an arranged pattern of the pixel circuits in each of the pixel blocks.

It should be noted that it is possible to consider the invention as a conceptualization of not only an electro-optical device but also an electronic apparatus including the electro-optical device.

BRIEF DESCRIPTION OF THE DRAWINGS

The invention will be described with reference to the accompanied drawings, wherein like numbers reference like elements.

DESCRIPTION OF EXEMPLARY EMBODIMENTS

An electro-optical device according to an embodiment of the invention is a liquid crystal device having liquid crystal elements as its electro-optical elements, where the electro-optical device is configured as follows. An element substrate on which various transistors and pixel electrodes are formed and an opposite substrate on which a common electrode is formed are attached with a certain space therebetween so that the electrode formation surfaces thereof are opposed to each other with a TN (twisted nematic) liquid crystal sandwiched in the space.

Figure 1:
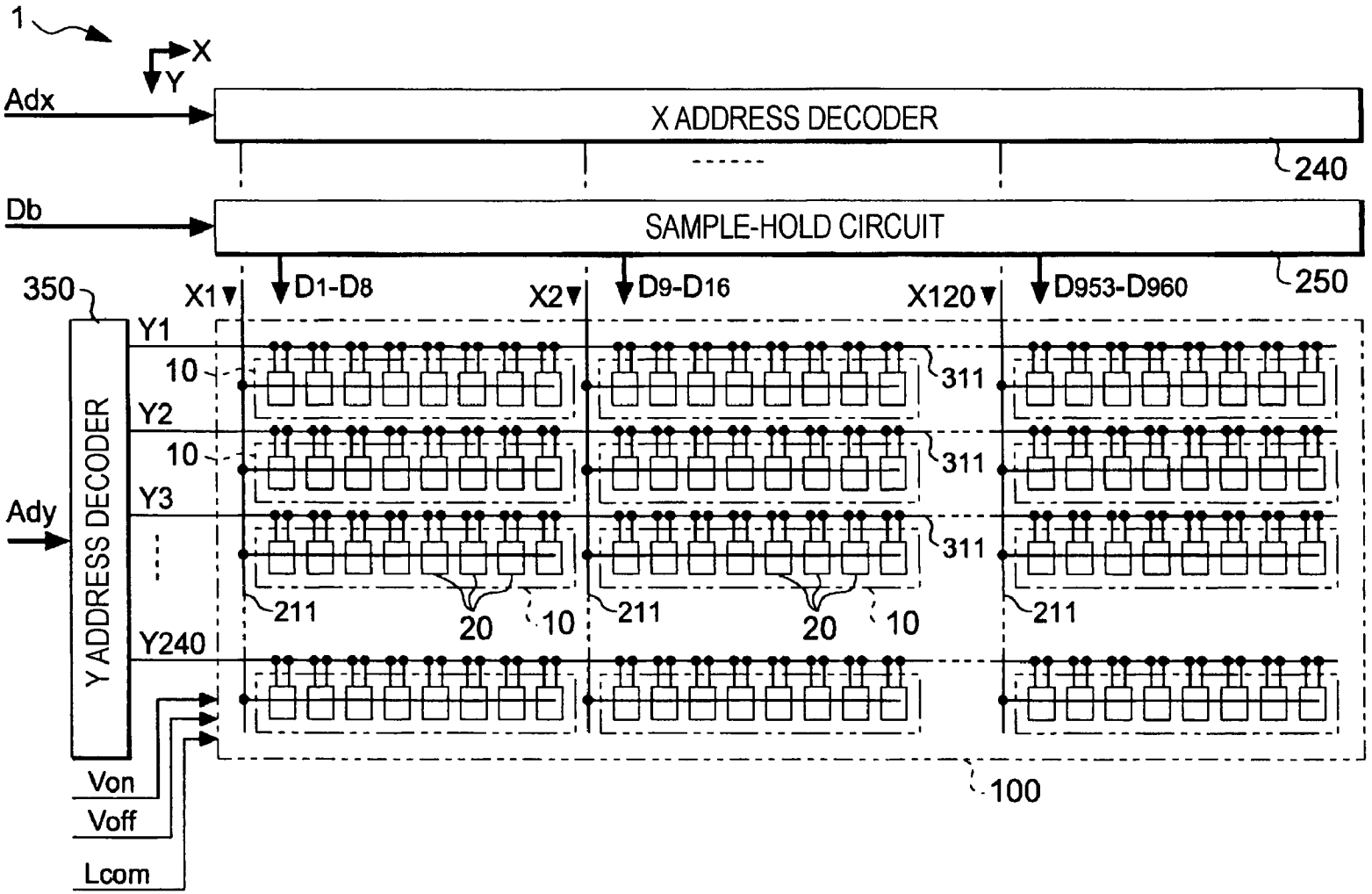
FIG. 1 is a block diagram illustrating a configuration of an electro-optical device according to an embodiment of the invention.

FIG. 1 is a block diagram illustrating an electric configuration of an electro-optical device 1 according to an embodiment of the invention.

As shown in this figure, a display area 100 of the electro-optical device 1 is provided with two hundred and forty lines of Y selection lines 311, each of which extends along a line (in the X direction), and one hundred and twenty columns of X selection lines 211, each of which extends along a column (in the Y direction). Each of a plurality of pixel blocks 10 is provided with respect to each intersection of the two hundred and forty lines of the Y selection lines 311 and the one hundred and twenty columns of the X selection lines 211. Therefore, according to this embodiment of the invention, the pixel blocks 10 are arranged in a matrix pattern of the 240 lines arrayed in the Y direction times the 120 columns arrayed in the X direction.

A Y address decoder 350 functions to output a line selection signal of H level exclusively to a Y selection line 311 corresponding to a line designated by means of a Y address Ady supplied from an upstream controlling circuit which is not shown in the figure. For convenience of explanation, in the display area 100, the line selection signal which is fed to the first, second, third, or - - - two hundred and fortieth line, counted from the top down, of the Y selection signal lines 311 is denoted as Y1, Y2, Y3, or - - - Y240, respectively. It should be noted that the line selection signal is denoted as Yi when the signal is explained generally without identifying any specific line. Herein, "i" denotes any integral that satisfies the mathematical condition of $1 \leqq i \leqq 240$.

On the other hand, an X address decoder 240 functions to output a column selection signal of H level exclusively to an X selection line 211 corresponding to a column designated by means of an X address Adx supplied from the controlling circuit. For convenience of explanation, in the display area 100, the column selection signal which is fed to the first, second, third, or - - - one hundred and twentieth column, counted from the left to the right, of the X selection signal lines 211 is denoted as X1, X2, X3, or - - - X120, respectively. It should be noted that the column selection signal is denoted as Xj when the signal is explained generally without identifying any specific column. Herein, "j" denotes any integral that satisfies the mathematical condition of $1 \leqq j \leqq 120$.

Figure 2:
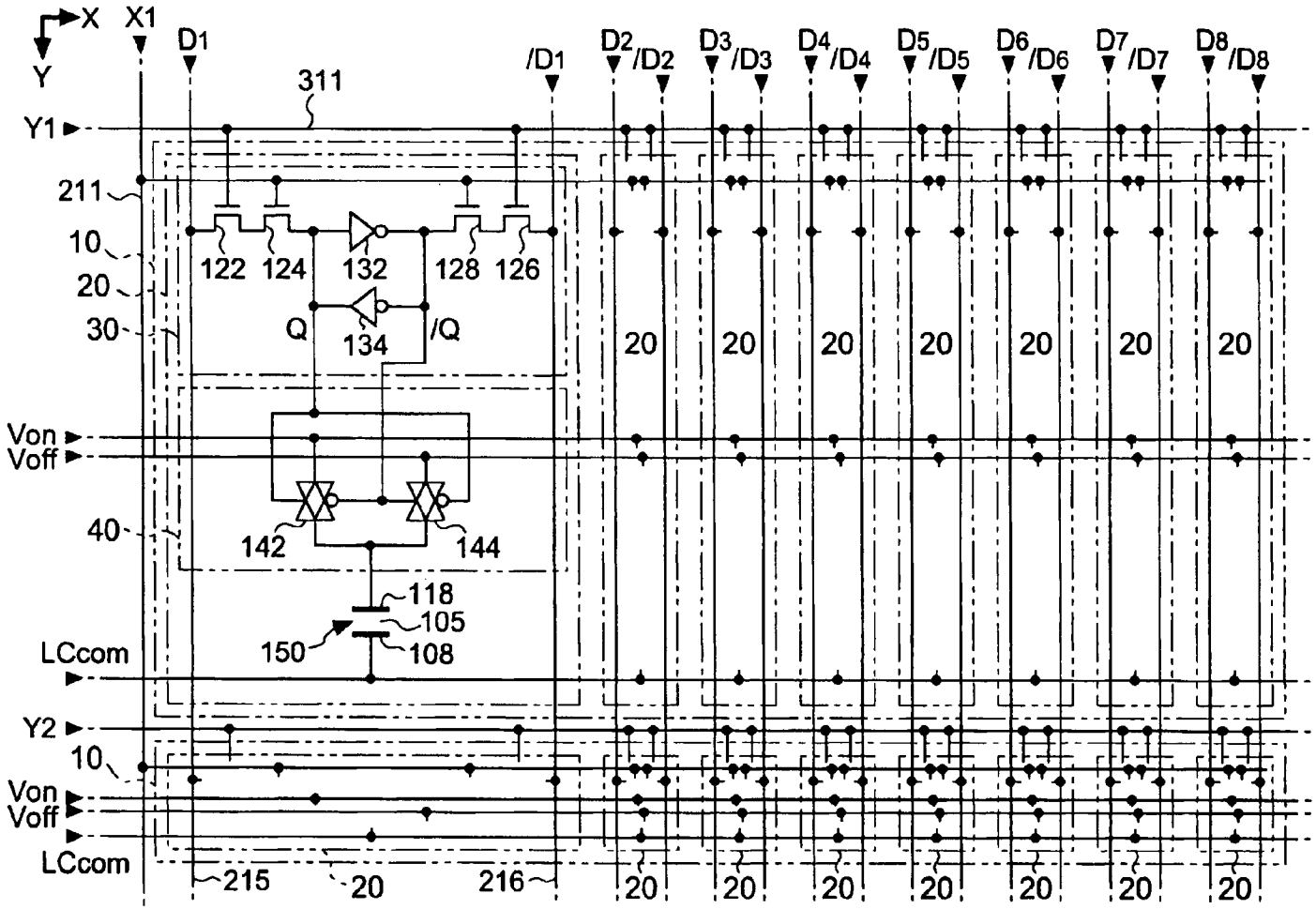
FIG. 2 is a diagram illustrating a configuration of a pixel block and other components/subcomponents in the electro-optical device according to the embodiment of the invention.

Next, the pixel blocks 10 are explained in detail. Each one of the pixel blocks 10 is identical to others in its configuration. Accordingly, the pixel block 10 corresponding to the intersection of the first line of the Y selection lines 311 and the first column of the X selection lines 211 is chosen for the purpose of explanation. FIG. 2 is a circuit diagram illustrating a configuration of the pixel block 10.

As illustrated in FIG. 2, one pixel block 10 includes eight pixel circuits 20 arranged in the X direction. Therefore, according to this embodiment of the invention, the pixel circuits 20 are arranged in a matrix pattern of the 240 lines arrayed in the Y direction times the 960 columns arrayed in the X direction.

Although omitted in FIG. 1, as illustrated in FIG. 2, a bit line 215 and a complementary bit line 216 are provided for each column of the pixel circuits 20 arranged in the matrix pattern so that the bit line 215 and the complementary bit line 216 extend along the column (in the Y direction). Nine hundred and sixty pairs of the bit lines 215 and the complementary bit lines 216 are provided because, as described above, there are nine hundred and sixty columns of the pixel circuits 20 arrayed in the X direction according to the embodiment of the invention.

For convenience of explanation, in the display area 100, a data bit which is fed to the first, second, third, or - - - nine hundred and sixtieth column, counted from the left to the right, of the bit lines 215 is denoted as $D_1$, $D_2$, $D_3$, or - - - $D_{960}$, respectively, whereas an inverted data bit which is fed to the first, second, third, or - - - nine hundred and sixtieth column, counted from the left to the right, of the complementary bit lines 216 is denoted as $/D_1$, $/D_2$, $/D_3$, or - - - $/D_{960}$, respectively. In this notation, eight pairs of the bit lines 215 and the complementary bit lines 216 counted from (8j minus 7) through (8j) correspond to the $j_{th}$ pixel block 10.

Each one of the pixel circuits 20 arranged in the matrix pattern of the 240 lines times the 960 columns is identical to the others. Therefore, in FIG. 2, the first line and the first column of the pixel circuit 20 is chosen for illustration.

As shown in FIG. 2, the pixel circuit 20 includes a static-type memory circuit 30, a selection circuit 40, and a liquid crystal element 150.

Among them, the memory circuit 30 includes N-channel-type thin-film transistors (hereafter simply referred to as "TFTs") 122, 124, 126, and 128 that function as a switching element, and NOT (inverter) circuits 132 and 134.

The source electrode of the TFT 122 is connected to the bit line 215, and the drain electrode of the TFT 122 is connected to the source electrode of the TFT 124, whereas the gate electrode of the TFT 122 is connected to the Y selection line 311. The drain electrode of the TFT 124 is connected to the input terminal of the NOT circuit 132, and the gate electrode of the TFT 124 is connected to the X selection line 211. The output terminal of the NOT circuit 132 is connected to the input terminal of the NOT circuit 134, and the output terminal of the NOT circuit 134 is connected to the input terminal of the NOT circuit 132 for feedback.

Herein, the input terminal of the NOT circuit 132 (output terminal of the NOT circuit 134) is considered as a non-inverting terminal Q of the memory circuit 30, while the input terminal of the NOT circuit 134 (output terminal of the NOT circuit 132) is considered as an inverting terminal /Q of the memory circuit 30.

As the memory circuit 30 is a complementary memory, the source electrode of the TFT 126 is connected to the complementary bit line 216, and the drain electrode thereof is connected to the source electrode of the TFT 128, whereas the gate electrode thereof is connected to the Y selection line 311. The drain electrode of the TFT 128 is connected to the input terminal of the NOT circuit 134, and the gate electrode thereof is connected to the X selection line 211.

According to the memory circuit 30 configured as above, when a line selection signal that is fed to the Y selection line 311 is turned to H level, and when a column selection signal that is fed to the X selection line 211 is also turned to H level, TFTs 122, 124, 126, and 128 are turned ON concurrently to store a bit Xj fed to the bit line 215, which is mentioned later, at a terminal Q and to store an inversion bit, which is the logical inversion of the bit Xj, at a terminal /Q, respectively.

The selection circuit 40 includes transmission gates 142 and 144. A signal Von is fed at the input terminal of the transmission gate 142, while a signal Voff is fed at the input terminal of the transmission gate 144. The output terminal of the transmission gate 142 and the output terminal of the transmission gate 144 are commonly connected to a pixel electrode 118, which is formed individually for each pixel. The non-inverting control gate of the transmission gate 142 and the inverting control gate of the transmission gate 144 are connected to the terminal Q of the memory circuit 30. The inverting control gate of the transmission gate 142 and the non-inverting control gate of the transmission gate 144 are connected to the terminal /Q of the memory circuit 30. Herein, the signal Von and the signal Voff are signals for turning the liquid crystal element, which is described later, ON and OFF respectively. These signals are provided from the upstream controlling circuit to each of the pixel circuits 20.

Each of the transmission gates 142 and 144 turns ON (becomes conductive) between its input terminal and output terminal when its non-inverting control gate is at H level (i.e., when its inverting control gate is in L level).

Accordingly, when the terminal Q of the memory circuit 30 is at H level, the transmission gate 142 is switched ON while the transmission gate 144 is switched OFF, thereby allowing only a signal Von to be applied to the pixel electrode 118. When the terminal Q of the memory circuit 30 is in L level, the transmission gate 142 is switched OFF while the transmission gate 144 is switched ON, thereby allowing only a signal Voff to be applied to the pixel electrode 118.

The liquid crystal element 150, which is an example of an electro-optical element, has a configuration in which a TN liquid crystal 105 is sandwiched between an individual pixel electrode 118 provided individually for each pixel and a common electrode 108 shared by all pixels.

Figure 3:
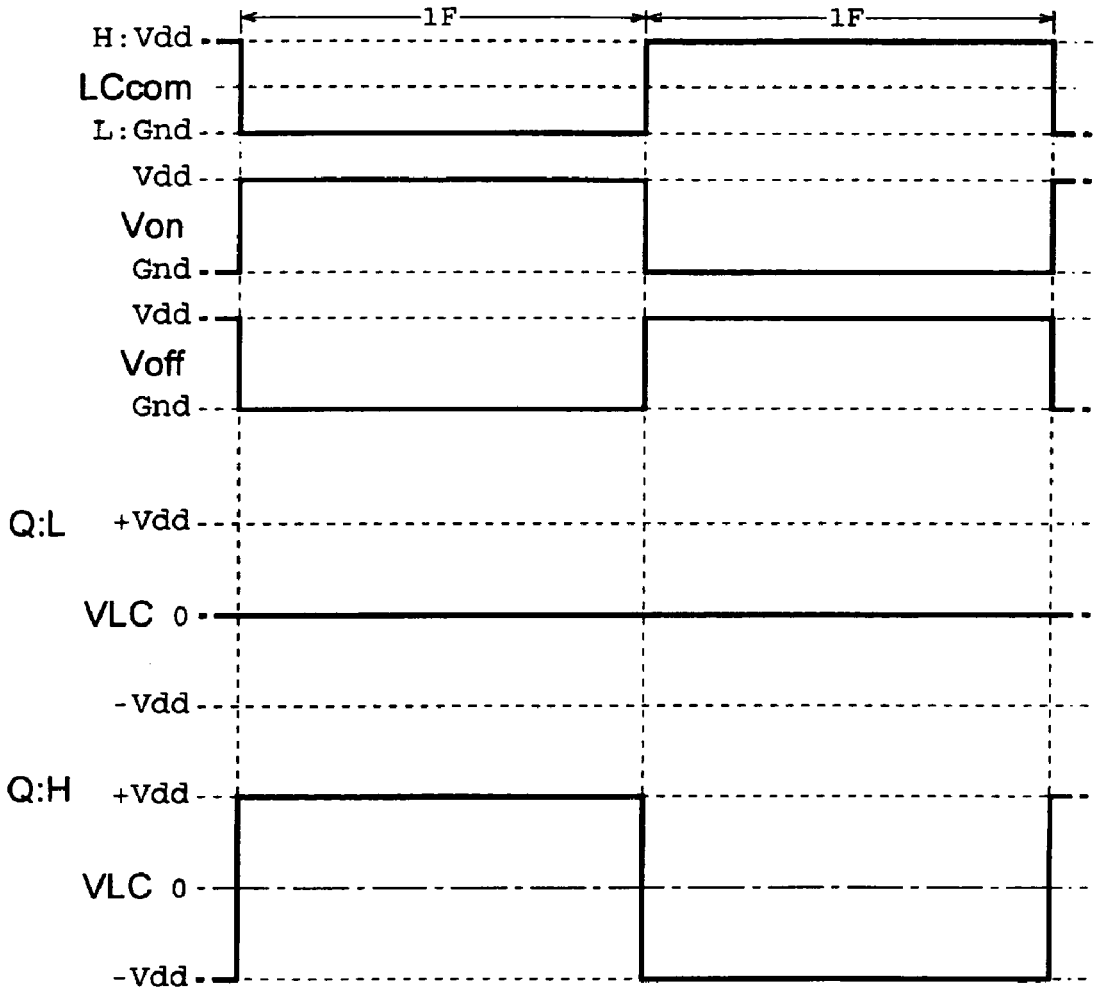
FIG. 3 is a chart illustrating memory circuit write-in operation in the electro-optical device according to the embodiment of the invention.

As illustrated in FIG. 3, in this embodiment of the invention, a signal LCcom, which reverses its polarity every frame (1F: approximately 16.7 milliseconds), is applied to the common electrode 108. In the same manner as the signals Von and Voff, the signal LCcom is supplied from the upstream controlling circuit commonly to each of the pixel circuits 20.

It should be noted that the logical level of the signal Von is opposite to that of the LCcom, while the logical level of the signal Voff is identical to that of the LCcom.

Each of the signals Von, Voff, and LCcom is at a supply voltage Vdd when at H level, while it is at a ground potential Gnd when at L level.

Though not specifically shown in the figure, each opposing surface of two substrates is provided with an alignment film, which is subjected to rubbing processing so that the long axes of liquid crystal molecules will be successively twisted by, for example, approximately ninety degrees between the two substrates, while polarizing devices are provided in accordance with alignment orientation. For this reason, a light that passes between the pixel electrode 118 and the common electrode 108 will be rotated by approximately ninety degrees along the twisted liquid crystal molecules if the effective voltage value between these electrodes is zero. As the effective voltage value becomes greater, the liquid crystal molecules get tilted toward an electric field direction, resulting in gradual loss of rotary polarization. Therefore, as the effective voltage value approaches zero, the reflectance (transmittance) of light increases, whereas the transmittance decreases as the voltage effective value increases (normally white mode).

Referring back to FIG. 1, a sample-hold circuit 250 samples eight data bits Db which are fed from the upstream controlling circuit to the eight columns of the bit lines 215 corresponding to the X selection lines 211 selected by the X address decoder 240 for transferring each of them, while the sample-hold circuit 250 performs logical inversion on each of the data bits Db to feed them to the corresponding eight columns of the complementary bit lines 216.

It should be noted that, in the embodiment of the invention, it is possible to form all of the X address decoder 240, the sample-hold circuit 250, the Y address decoder 350, and the component elements in the pixel block 10 concurrently through a low-temperature polysilicon process.

Next, the operation of the electro-optical device according to the embodiment of the invention is described.

First of all, the memory operation of storing a data bit into the memory circuit 30 is explained because a state in which a data bit is stored in the memory circuit 30 of each of the pixel circuits 20 is a prerequisite for the workings of the electro-optical device 1.

According to this embodiment of the invention, the operation of storing a data bit in the memory circuit 30 is carried out in a pixel block 10 functioning as an operation unit. For example, in order to store data bits in the eight pixel circuits 20 in the pixel block 10 arrayed at the $i_{th}$ line and the $j_{th}$ column, the upstream controlling circuit outputs a Y address Ady that designates the $i_{th}$ line as well as an X address Adx that designates the $j_{th}$ column; and the upstream controlling circuit also outputs eight data bits Db which are intended to be stored in the pixel circuits 20 which belong to the pixel block 10, that is, the pixel circuits 20 arrayed at the $i_{th}$ line and from the $(8j \text{ minus } 7)_{th}$ column through $(8j)_{th}$ column.

Upon reception of the X address Adx, the X address decoder 240 sets a column selection signal Xj to H level. Then, the sample-hold circuit 250 samples eight data bits Db which are intended to be stored, and feeds them to the eight bit lines 215 corresponding to the $j_{th}$ column. More specifically, the sample-hold circuit 250 outputs eight data bits Db which are intended to be stored in the pixel circuits 20 arrayed at the $i_{th}$ line and from the $(8j \text{ minus } 7)_{th}$ column through the $(8j)_{th}$ column, where the output is fed to the bit lines 215 provided from the $(8j \text{ minus } 7)_{th}$ column through the $(8j)_{th}$ column as bits $X_{(8j \text{ minus } 7)}$, $X_{(8j \text{ minus } 6)}$, $X_{(8j \text{ minus } 5)}$, - - - , $X_{(8j)}$.

In addition, the sample-hold circuit 250 performs logical inversion on the data bits Db which are intended to be stored, and feeds the logically-inverted bits to the complementary bit lines 216 provided from the $(8j \text{ minus } 7)_{th}$ column through the $(8j)_{th}$ column as bits $X_{(8j \text{ minus } 7)}$, $X_{(8j \text{ minus } 6)}$, $X_{(8j \text{ minus } 5)}$, - - - , $X_{(8j)}$.

It should be noted that the sample-hold circuit 250 does not feed any data bits to other bit lines 215 and complementary bit lines 216.

On the other hand, upon reception of the Y address Ady, the Y address decoder 350 sets a line selection signal Yi only to H level.

In the eight pixel circuits 20 which belong to the pixel block 10 at the $i_{th}$ line and the $j_{th}$ column, the TFTs 122 and 126 are turned into an ON state as the line selection signal Yi is set at H level, and the TFTs 124 and 128 are turned into an ON state as the column selection signal Xj is set at H level; and therefore, the bit which is fed to the bit line 215 and the bit which is fed to the complementary bit line 216 are written into the terminal Q and the terminal /Q, respectively.

In this state, when either one or both of the line selection signal Yi and the column selection signal Xj is/are turned to L level, in the eight pixel circuits 20 which belong to the pixel block 10 at the $i_{th}$ line and the $j_{th}$ column, the TFTs 122 and 126 are turned into an OFF state, or the TFTs 124 and 128 are turned into an OFF state, or both of them are turned into an OFF state. For this reason, in the memory circuit 30, although the terminal Q and the terminal /Q are electrically cut off respectively from the bit line 215 and the complementary bit line 216, the memory circuit 30 retains the written bit.

It should be noted that, when both of the column selection signal Xj and the line selection signal Yi are at H level herein, it follows that either one or both of a line selection signal and a column selection signal is/are in L level in any pixel circuits 20 which belong to any pixel block other than the pixel block 10 at the $i_{th}$ line and the $j_{th}$ column.

Therefore, in these pixel circuits 20, as either one or both of TFTs 122 and 124 (126 and 128) is/are turned into an OFF state, the terminal Q of the memory circuit 30 is electrically cut off from the bit line 215, while the terminal /Q of the memory circuit 30 is electrically cut off from the complementary bit line 216. For this reason, none of the memory circuits 30 in any pixel circuits 20 which belong to any pixel block other than the pixel block 10 at the $i_{th}$ line and the $j_{th}$ column is affected by the voltage change at the bit line 215 and the complementary bit line 216.

That is, in these memory circuits 30 in the pixel circuits 20, the data bit, if it has already been written, is retained independently of the voltage state at the bit line 215 and the complementary bit line 216.

Immediately after power activation, the above-described write-in operation is carried out for all pixel blocks 10, which results in the retaining of a data bit either at H level or L level in each memory circuit 30 in each of the pixel circuits 20.

In like manner, when display content is changed, a set of eight data bits Db which specifies new display content after change is fed from the upstream controlling circuit as well as the X address Adx and the Y address Ady, and each of the data bits held by eight of the memory circuits 30 in the pixel block 10 designated by the X address Adx and the Y address Ady is subjected to rewriting.

Next, it is explained how the liquid crystal element 150 works when a data bit is held in each of the pixel circuits 20 as described above.

First of all, the transmission gate 142 and the transmission gate 144 are respectively switched OFF and ON when the terminal Q is held at L level (i.e., the terminal /Q is held at H level) in the memory circuit 30 of the pixel circuit 20; and accordingly, the signal Voff, which is logically identical to the common electrode 108, is applied to the pixel electrode 118 of the pixel as illustrated in FIG. 3. Accordingly, a voltage applied to the liquid crystal element 150, VLC, which is the difference between the electric potential of the pixel electrode 118 and the electric potential of the common electrode 108, is zero. Therefore, the pixel indicates a bright OFF state under a normally-white mode.

On the other hand, the transmission gate 142 and the transmission gate 144 are respectively switched ON and OFF when the terminal Q is held at H level (i.e., the terminal /Q is held at L level) in the memory circuit 30 of the pixel circuit 20; and accordingly, the signal Von, which is logically opposite to the common electrode 108, is applied to the pixel electrode 118 of the pixel as illustrated in FIG. 3. Accordingly, the voltage VLC applied to the liquid crystal element 150 is Vdd in its absolute value; and therefore, the pixel indicates a dark ON state under a normally-white mode.

Depending on the bit-hold state in the memory circuit 30, either the ON-state display or the OFF-state display is carried out in each of the pixel circuits 20 as described above so that a predetermined image is displayed.

As described above, according to the embodiment of the invention, TFTs 122, 124, 128, and 126 are put into a conductive state in a pixel block 10 corresponding to an intersection of an X selection line 211 and a Y selection line 311 so as to rewrite a data bit, whereas TFTs in memory circuits 30 of any pixel blocks 10 other than the selected pixel block are not put into a conductive state. Therefore, in comparison with a configuration of rewriting a data bit where a data line driver puts a data line into a high impedance state, the embodiment of the invention achieves lower power consumption.

In addition, according to the embodiment of the invention, in any pixel blocks other than the pixel block 10 corresponding to the intersection of a line designated by a Y address Ady and a column designated by an X address Adx, a terminal Q of a memory circuit 30 is electrically cut off from a bit line 215, while a terminal /Q of the memory circuit 30 is electrically cut off from a complementary bit line 216. Therefore, the embodiment of the invention makes it possible to prevent the content of a bit held at the memory circuit from being affected by any noise which resides in the bit line 215 or the complementary bit line 216.

According to the embodiment of the invention described above, each one column of an X selection line 211 is connected to two hundred and forty pixel blocks 10, where each one of the pixel blocks 10 includes eight pixel circuits 20, and the gates of TFTs 124 and 128 in each one of the pixel circuits 20 are connected to the X selection line 211. Therefore, the number of TFTs of which gates are connected to said one column of an X selection line 211 is 3,840 (=240 times 8 times 2). On the other hand, as each one line of a Y selection line 311 is connected to one hundred and twenty pixel blocks 10, the number of TFTs of which gates are connected to said one line of a Y selection line 311 is 1,920 (=120 times 8 times 2).

Accordingly, if it is assumed that the transistor size (in particular, channel width) of TFT 122 (126) is the same as the transistor size of TFT 124 (128), the gate capacitance of one column of an X selection line 211 will be larger than the gate capacitance of one line of a Y selection line 311, which is undesirable.

As it is usual to scan a screen vertically and horizontally when rewriting a data bit, it is reasoned that the number of times of selecting a Y selection line 311 tends to be greater than the number of times of selecting an X selection line 211. Taking an aim of reducing power consumption into consideration, it would be preferable if the capacitance load for selecting the X selection line 211 once were smaller.

Leaving wiring capacity out of consideration, for example, if the channel widths of the TFTs 124 and 128 are narrowed to the half of the channel widths of the TFTs 122 and 126, the gate capacitance at one column of an X selection line 211 will become almost equal to the gate capacitance at one line of a Y selection line 311.

However, in order to rewrite a data bit for each of all pixel circuits 20 in one line, it is necessary to select an X selection line 211 sequentially from one column to another, while a Y selection line is selected just once (i.e., selection of an X selection line 211 is performed one hundred and twenty times), which necessitates a further reduction of the capacitance load at the X selection line 211. However, there is a limit in narrowing the channel widths of transistors.

As a solution, instead of sharing just a single X selection line 211 among two hundred and forty pixel blocks 10 in one column, it may alternatively be configured so that the pixel blocks corresponding to the column are divided into a plurality of groups, where the pixel blocks in each group share an X selection line 211.

Figure 4:
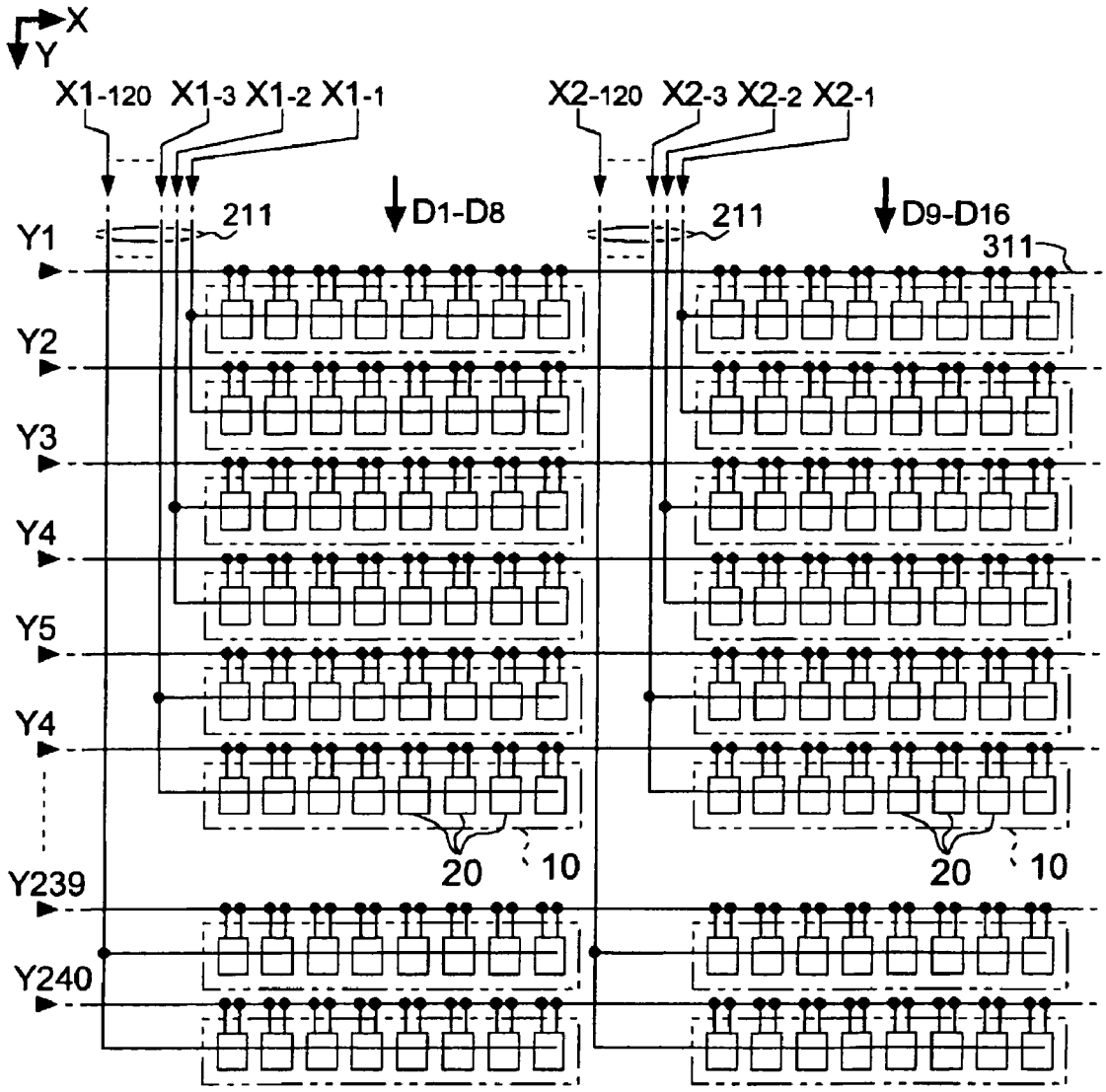
FIG. 4 is a wiring diagram illustrating a configuration of pixel blocks and other components/subcomponents in the electro-optical device according to an application example of the invention.

FIG. 4 illustrates a configuration example in which pixel blocks 10 corresponding to one column are divided into groups, in which each group includes two of the pixel blocks corresponding to said one column, and the two pixel blocks in each group share an X selection line 211.

More specifically, in this example, as there are two hundred and forty pixel blocks 10 in one column, it follows that the pixel blocks 10 are divided into one hundred and twenty groups in said one column, in which each group includes two thereof. Therefore, one hundred and twenty X selection lines 211 are provided for said one column. In such a configuration, the X address decoder 240 feeds a column selection signal $X1_{-1}$, $X1_{-2}$, $X1_{-3}$, . . . , $X1_{-120}$, for the first column; or if it is paraphrased without specifying any column, the X address decoder 240 feeds a column selection signal $Xj_{-1}$, $Xj_{-2}$, $Xj_{-3}$, . . . , $Xj_{-120}$, for the $J_{th}$ column.

Although not specifically shown in the figure, according to such a configuration, not only an X address Adx but also a Y address Ady are fed to the X address decoder 240. By this means, the X address decoder 240 is able to output a column section signal corresponding to a group to which a line designated by the Y address Ady belongs in the column designated by the X address Adx. For example, in the configuration illustrated in FIG. 4, assuming that the column designated by the X address Adx is the second column counted from the left and that the line designated by the Y address Ady is the third line counted from the top, the X address decoder 240 sets a column section signal $X2_{-2}$ only at H level. It should be noted that, in this configuration, the Y address decoder 350 sets a line selection signal corresponding to the line designated by the line address Ady at H level just in the same manner as done in the configuration shown in FIG. 1.

By the way, if pixel blocks 10 in one column are divided into a plurality of groups, the number of X selection lines 211 required for said one column of the pixel blocks 10 increases exponentially (for example, according to the example in FIG. 4, the number thereof increases from one to one hundred and twenty). For this reason, a necessity of providing a wiring area, which accommodates X selection lines 211, arises for each column of the pixel blocks 10 (in other words, for every set of eight pixel circuits 20).

On the other hand, taking a semiconductor manufacturing process (in particular, mask patterning at the time of light exposure) into consideration, assuming that pixel circuits 20 are arranged in a matrix pattern as in the embodiment of the invention, it is desirable to have a repetitive pattern configuration with a pixel block 10 as a unit thereof.

The two-dimensional arrangement of pixel blocks 10 and pixel circuits 20 as shown in FIG. 4 is one conceivable arrangement; however, there is a disadvantage in such an arrangement in that a user will feel something unnatural on screen display due to the different space (pitch) between pixel electrodes 118.

Figure 5:
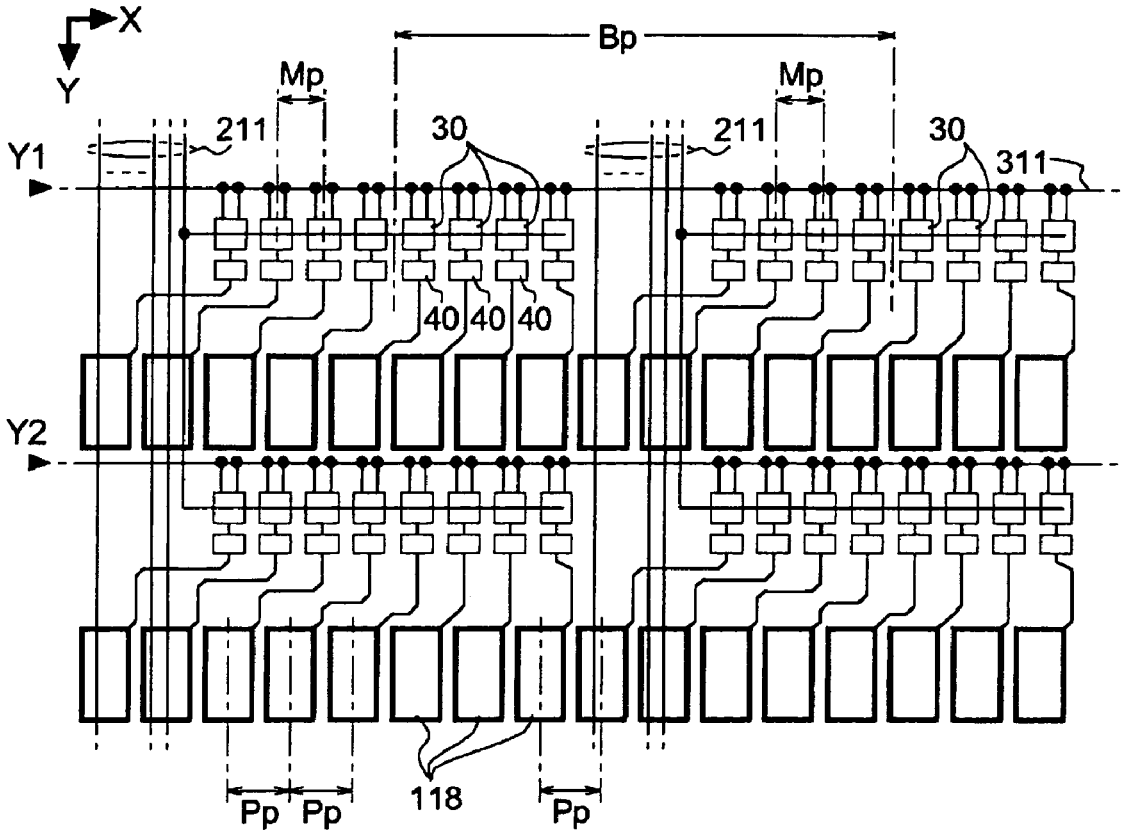
FIG. 5 is a plane view illustrating a configuration of components/subcomponents in pixel blocks in the electro-optical device according to an application example of the invention.

In order to overcome the disadvantage, as illustrated in FIG. 5, it is preferable that the memory circuits 30 and the selection circuits 40 in the pixel circuits 20 are arranged in accordance with the arrangement of the pixel block 10 whereas the pixel electrodes in the pixel circuits 20 are arranged with a regular pitch independently of the arrangement of the pixel block 10.

More specifically, assuming that the display area 100 is configured as a reflective mode, the memory circuits 30 and the selection circuits 40 are formed on an element substrate to be arrayed in the X direction with a pitch Mp as well as the X selection lines 211 and the Y selection lines 311, and then the pixel electrodes 118 are formed thereon with a pitch Pp so as to cover them with an insulation layer sandwiched therebetween. Although the pixel electrodes 118 according to FIG. 5 are shifted in the Y direction with respect to the memory circuits 30 and the selection circuits 40 for the purpose of explanation, in actual implementation, the pixel electrodes 118 are arrayed to cover the X selection lines 211, the memory circuits 30, and the selection circuits 40 (that is, the pixel electrodes 118 are disposed on a layer above the layer of the memory circuits 30 and the selection circuits 40) with as less space as possible therebetween. Therefore, the array pitch Pp of the pixel electrodes 118 is wider than the array pitch Mp of the memory circuits 30 and the selection circuits 40. In addition, according to the embodiment of the invention, an array pitch Bp of the pixel blocks 10 is eight times as long as the array pitch Pp.

Although the number of pixel circuits 20 included in a pixel block 10 is assumed as eight in the above embodiment of the invention, it should be noted that it may be other plural numbers. Alternatively, a pixel block 10 may include just a single pixel circuit 20.

In addition, although it is assumed that the level of a signal LCcom is reversed for each one frame-duration according to the above embodiment of the invention, the reason why the level of the signal LCcom is reversed is only to drive a liquid crystal element 150 by an alternating current. It may alternatively be configured so that the level of the signal LCcom is subjected to reversing for every two or more frames.

Moreover, although it is assumed that a liquid crystal element 150 is one of normally white mode types according to the above embodiment of the invention, the liquid crystal element 150 may alternatively be configured as one of normally black mode types, which provides a dark state when no voltage is applied.

Furthermore, although a binary ON/OFF display is assumed for simplifying explanation according to the above embodiment of the invention, each pixel circuit 20 may alternatively be configured to correspond to three primary colors of RGB RGB . . . in the X direction, for example, thereby to provide eight color display while turning each color ON/OFF.

Alternatively, in an embodiment of the invention, each pixel circuit 20 may be configured to support colors with a hue range varied with respect to three primary colors of RGB in the X direction; and in addition thereto, another color (e.g. cyan (C)) may be added to support four colors of RGBC RGBC . . . thereby to enhance color reproduction.

Still moreover, a display is not limited to a reflection type, but may be a transmission type, or a transflective type, which is categorized between them. Still furthermore, other than a TN type, alternative types such as an STN liquid crystal may be used. Among others is a guest-host type liquid crystal in which a dye (guest) having anisotropic absorption of visible radiation, anisotropic between a long axial direction and a short axial direction of molecules, is dissolved into a certain molecular arrangement of liquid crystal (host) so that the dye molecules and the liquid crystal molecules are arranged in parallel. Still moreover, it may be configured as a homeotropic liquid crystal (in homeotropic alignment), in which liquid crystal molecules are aligned in vertical orientation with respect to two substrates when no voltage is applied whereas the liquid crystal molecules are aligned in horizontal orientation with respect to the two substrates when a voltage is applied. Or, it may be configured as an IPS (in-plane switching mode, including FSS) liquid crystal.

Other than a liquid crystal element, an electro-optical element of the invention includes an EL (electroluminescence) element, an electrophoresis element, an electron emission element, a digital mirror element, and so on. The invention is also applicable to a plasma display. That is, the invention is applicable to all electro-optical devices that store binary data bits for dictating ON/OFF into memory circuits.

Electronic Apparatus

Figure 6:
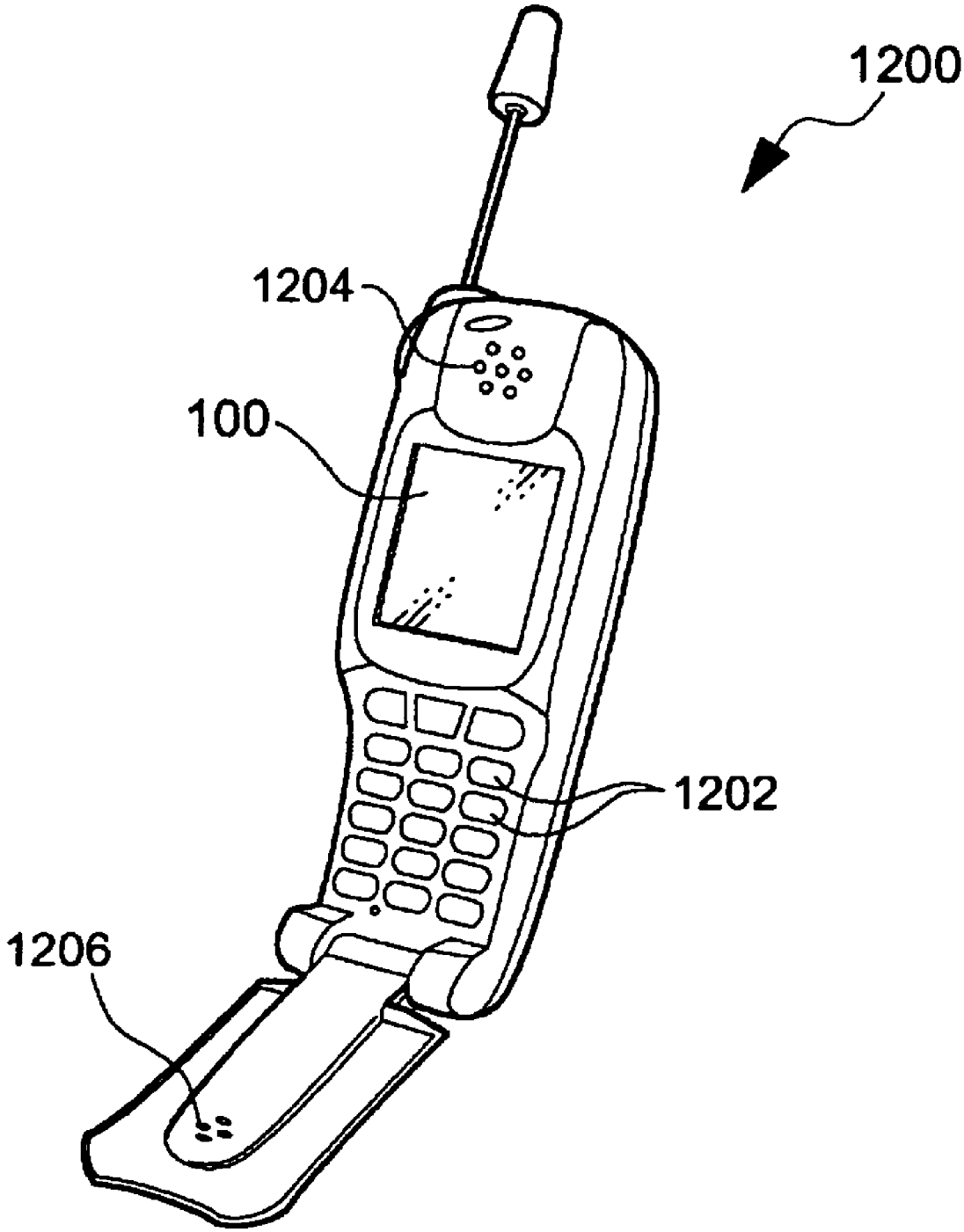
FIG. 6 is a diagram illustrating a configuration of a mobile phone that includes an electro-optical device according to an embodiment of the invention.

Next, an electronic apparatus having the electro-optical device 1 according to the above-described embodiment as its display device is explained. FIG. 6 is a diagrammatic perspective view of a mobile phone 1200 that includes the electro-optical device 1 according to the above-described embodiment.

As illustrated in the figure, the mobile phone 1200 is provided with a plurality of manual operation buttons 1202, an earpiece 1204, a mouthpiece 1206, and a display area 100 of the electro-optical device 1 according to the above-described embodiment. Except the display area 100, other components of the electro-optical device 1 do not appear, and so they are not visually recognized.

Among a variety of electronic apparatuses to which the electro-optical device 1 is applicable are, other than the mobile phone illustrated in FIG. 6, a digital still camera, a notebook-sized personal computer, a liquid crystal television, a video recorder of a viewfinder type (or a direct monitor view type), a car navigation device, a pager, an electronic personal organizer, an electronic calculator, a word processor, a workstation, a videophone, a POS terminal, a touch-panel device, and so forth. Needless to say, it is possible to embody the above-described electro-optical device 1 as a display device for such a variety of electronic apparatuses. Any of these electronic apparatuses will enjoy the benefit of reduced power consumption, which is offered by the electro-optical device 1 according to the invention.

What is claimed is:

1. An electro-optical device comprising:

an X address decoder that selects one of a plurality of X selection lines;

a Y address decoder that selects one of a plurality of Y selection lines; and a plurality of pixel blocks, each of the pixel blocks being arranged corresponding to intersections of the plurality of the X selection lines and the plurality of the Y selection lines;

wherein each of the plurality of the pixel blocks includes a plurality of pixel circuits, the pixel circuits of a same column share both a common bit line and a common complementary bit line, different from the common bit line, each of the pixel circuits includes a memory circuit, a selection circuit, and a pixel electrode, the memory circuit includes a plurality of transistors that become conductive between the bit line, the complementary bit line, and terminals of the memory circuit at a time of concurrent selection of a respective X selection line and Y selection line corresponding to the pixel block including the plurality of the transistors, the memory circuit storing a data bit which is fed to the corresponding bit line when the plurality of the transistors are conductive, and the selection circuit selects a signal that turns an electro-optical element into an ON state or an OFF state according to the data bit stored in the memory circuit, so as to feed the selected signal to the pixel electrode, wherein the memory circuit is a complementary memory, and the plurality of transistors that become conductive between the bit line, the complementary bit line, and terminals of the memory circuit at a time of concurrent selection of a respective X selection line and Y selection line corresponding to the pixel block including the plurality of the transistors are all conductive at a same time to input to the memory circuit, at the same time, the data bit on the common bit line and a complementary data bit on the common complementary bit line.

2. The electro-optical device according to claim 1, wherein the memory circuit includes:

a first transistor having a gate electrode that is electrically coupled to the Y selection line and a source electrode that is electrically coupled to the bit line;

a second transistor having a gate electrode that is electrically coupled to the X selection line, a source electrode that is electrically coupled to a drain electrode of the first transistor, and a drain electrode that is electrically coupled to one terminal of an inverter circuit;

a third transistor having a gate electrode that is electrically coupled to the Y selection line and a source electrode that is electrically coupled to the complementary bit line; and a fourth transistor having a gate electrode that is electrically coupled to the X selection line, a source electrode that is electrically coupled to a drain electrode of the third transistor, and a drain electrode that is electrically coupled to another terminal of the inverter circuit.

3. The electro-optical device according to claim 2, wherein channel widths of the second transistor and the fourth transistor are narrower than channel widths of the first transistor and the third transistor.

4. The electro-optical device according to claim 1, wherein the pixel blocks of a same column share a common X selection line.

5. The electro-optical device according to claim 1, wherein the pixel blocks of a same column are divided into a plurality of groups, the pixel blocks in each group sharing a common X selection line.

6. The electro-optical device according to claim 5, wherein a plurality of the pixel circuits are arranged to form a line in each of the pixel blocks, the electro-optical element has a pixel capacity, the pixel capacity including an individual pixel electrode that is individually provided for each pixel circuit and a common electrode that is shared by all of the pixel circuits, and an array pitch of the pixel electrode that is wider than an array pitch of the memory circuit when viewed along an arranged pattern of the pixel circuits in each of the pixel blocks.

7. The electro-optical device according to claim 1, wherein the selection circuit includes:

a first transmission gate having an input terminal that receives a signal for turning the electro-optical element into an ON state and an output terminal that is electrically coupled to the pixel electrode, a second transmission gate having an input terminal that receives a signal for turning the electro-optical element into an OFF state and an output terminal that is electrically coupled to the pixel electrode, and the selection circuit controlling the first transmission gate and the second transmission gate according to the data bit.

8. An electronic apparatus comprising the electro-optical device according to claim 1.

9. An electro-optical device comprising:

a plurality of X selection lines;

a plurality of Y selection lines that are arranged to intersect with the plurality of X selection lines;

a plurality of pixel blocks that are each arranged to correspond with respective intersections of the X and Y selection lines;

each pixel block includes a plurality of pixel circuits, with each pixel circuit of a same column sharing a both a common bit line and a common complementary bit line, different from the common bit line, each of the pixel circuits further including:

a memory circuit that includes a plurality of transistors that become conductive between the bit line, the complementary bit line and terminals of the memory circuit during a concurrent selection of respective X selection and Y selection lines corresponding to the pixel block, the memory circuit storing a data bit which is transmitted to the corresponding bit line when the plurality transistors are conductive;

a selection circuit that selects a signal that switches an electrode-optical element between an ON state or OFF state according to the data bit stored in the memory circuit so as to transmit the selective signal to a pixel electrode, wherein the memory circuit is a complementary memory, and the plurality of transistors that become conductive between the bit line, the complementary bit line, and terminals of the memory circuit during a concurrent selection of respective X selection and Y selection lines corresponding to the pixel block are all conductive at a same time to input to the memory circuit, at the same time, the data bit on the common bit line and a complementary data bit on the common complementary bit line.

* * * * *